US005385591A

United States Patent [19]

Ramanath et al.

[11] Patent Number: 5,385,591

[45] Date of Patent: Jan. 31, 1995

[54] METAL BOND AND METAL BONDED ABRASIVE ARTICLES

[75] Inventors: Srinivasan Ramanath; William H. Williston, both of Holden, Mass.

[73] Assignee: Norton Company, Worcester, Mass.

[21] Appl. No.: 128,399

[22] Filed: Sep. 29, 1993

[51] Int. Cl.[6] ..... B24D 3/02

[52] U.S. Cl. ..... 51/309; 51/293; 428/546

[58] Field of Search ..... 51/293, 295, 309; 428/546

[56] References Cited

U.S. PATENT DOCUMENTS 4,698,070 10/1987 Ohno ..... 51/309
4,977,710 12/1990 Une ..... 51/309
5,035,771 7/1991 Borse ..... 51/293
5,085,671 2/1992 Martin et al. ..... 51/293

*Primary Examiner*—Mark L. Bell
*Assistant Examiner*—Deborah Jones
*Attorney, Agent, or Firm*—Brian M. Kolkowski

[57] ABSTRACT

The present invention is a metal bond comprising a filler with a Vickers hardness from about 300 kg/mm$^2$ to about 800 kg/mm$^2$ wherein the Vickers hardness of the filler is maintained above 300 kg/mm$^2$ upon firing of the bond at a temperature above 700° C. for at least about 10 minutes. The present invention further is an abrasive tool comprising a metal core; an abrasive composition comprising diamond and the above metal bond, bonded to the metal core.

14 Claims, No Drawings

METAL BOND AND METAL BONDED ABRASIVE ARTICLES

BACKGROUND OF THE INVENTION

1. Field of the Invention

The invention is a metal bond which processes at higher temperatures while maintaining the mechanical properties such as hardness of the fillers used in the bond. The invention is further the abrasive tools made from the metal bond.

2. Technology Review

Metal bonded diamond abrasive grinding wheels are used in the edge grinding of glass. These wheels typically contain a metal bonded diamond abrasive applied to a metal core. To produce a wheel, the metal bonded diamond abrasive is bonded by a hot-pressing or hot-coining process to the metal core.

The metal bond which contains the diamond abrasive generally comprises a combination of several metals and a steel filler. The compositions of the metal bonds should be selected to optimize both the efficiency of cut and the wheel life. To increase the wheel life, the bond preferably contains fillers with high hardness and a bond with little or no porosity after processing. To improve the efficiency of cut which is a measure of the rate at which a given length of glass edge can be ground, the bond preferably contains certain hard phases such as a copper-titanium phase which allow the bond to be durable and yet fracture periodically thereby improving the bonds ability to release dull or worn abrasives which increases the grinding rate or the efficiency of cut.

The steel fillers typically used in grinding wheels are alloy steels. These fillers result in wheels which do not have both an optimized efficiency of cut and wheel life. This is because these alloy steels have a hardness of from 300–700 kg/mm$^2$ before processing which decreases when the metal bonded diamond abrasive to which the fillers are added are hot-pressed at the higher temperatures required to eliminate porosity from the finished product. When the metal bonded diamond abrasive is hot-pressed at the lower temperatures required to maintain the hardness of the steel filler, porosity in the finished product is not removed. This porosity can only be removed at lower temperatures by using higher hot-pressing pressures which results in decreased life of the graphite hot-pressing molds and results in higher processing costs.

Another drawback of processing the metal bonded diamond abrasive at lower temperatures is the absence of certain brittle phases in the bond such as the copper-titanium phase allow the bond to fracture periodically and thereby improve the bonds ability to release dull or worn abrasives. This phase tends to form at higher temperatures and does not appear or appears in lower concentrations at these temperatures thereby decreasing the efficiency of cut.

It is therefore an object of this invention to create a metal bond that can be incorporated in a wheel and result in both increased wheel life and efficiency of cut.

SUMMARY OF THE INVENTION

The present invention is a metal bond comprising a filler wherein the Vickers hardness of the filler is maintained above 300 kg/mm$^2$ upon firing of the bond at a temperature above 700° C. for at least about 10 minutes. The present invention further is an abrasive tool comprising a metal core; an abrasive composition comprising diamond and the above metal bond, bonded to the metal core.

DETAILED DESCRIPTION OF THE INVENTION

The present invention is a metal bond comprising a filler. The metal bond comprising the filler may further include copper, titanium, silver and tungsten carbide. The filler is preferably a filler with a Vickers hardness of from about 300 kg/mm$^2$ to about 800 kg/mm$^2$ before firing of the bond, more preferably from about 300 kg/mm$^2$ to about 700 kg/mm$^2$ before firing of the bond, and most preferably from about 300 kg/mm$^2$ to about 600 kg/mm$^2$ before firing of the bond. The use of the filler in the metal bond is unique because the filler maintains its Vickers hardness in the metal bond preferably above 300 kg/mm$^2$ when fired at a temperature in excess of 700° C. for at least about 10 minutes, more preferably above 300 kg/mm$^2$ when fired at a temperature in excess of 750° C. for at least about 10 minutes, and most preferably above 300 kg/mm$^2$ when fired at a temperature in excess of 800° C. for at least about 10 minutes.

The filler may be ceramic, metal or combinations thereof. The filler is preferably steel. The steel filler is preferably reduced by subjecting the steel to an elevated temperature and a reducing atmosphere. The steel filler is more preferably T15 Steel with the composition of about 5.1 wt % Co, 4.1 wt % Cr, 4.9 wt % V, 12.2 wt % W, 0.34 wt % Mn, 0.24 wt % Si, 1.43 wt % C, 0.02 wt % S with the balance being Fe.

The filler is preferably from about 10 to about 70 volume % of the total metal bond, more preferably from about 20 to about 60 volume % of the total metal bond, and most preferably from about 30 to about 55 volume % of the total metal bond. The average particle size of the filler is preferably from about 1 to about 400 microns, more preferably from about 10 to about 180 microns, and most preferably from about 20 to about 120 microns.

The bond may further comprise copper and silver. Preferably in addition to the filler the bond comprises from about 20 to about 52% by volume of silver, and from about 1 to about 14% by volume of copper, more preferably comprises from about 20 to about 45% by volume of silver, and from about 5 to about 12.5% by volume of copper, and most preferably comprises from about 21 to about 41% by volume silver, and from about 8 to about 11.5% by volume of copper in relation to the total bond composition. The total bond composition being the filler, metals and other additives in the bond. The bond may further preferably comprise titanium and tungsten carbide. The bond more preferably comprises from about 5 to about 50% by volume of titanium and from about 0.5 to about 25% by volume of tungsten carbide, and most preferably comprises from about 5 to about 30% by volume of titanium and from about 5 to about 20% by volume of tungsten carbide. The bond after firing preferably contains from about 2 to about 60% by volume of copper-titanium phase, more preferably from about 2 to about 50% by volume copper-titanium phase, and most preferably from about 5 to about 35% by volume of copper-titanium phase.

The bond is used in the formation of abrasive tools. The abrasive tools comprise a metal core; and an abrasive composition bonded to the metal core comprising an abrasive and the metal bond described above. The shape of the metal core used is determined by the function to be performed. For example in the preferred embodiment the abrasive tool is an edging wheel for the edging of glass. The metal core is a ring shape, the outer circumference of the metal core is where the abrasive composition is mounted. The metal core may be shaped by methods known to those skilled in the art such as for example forging, machining, and casting.

The abrasive composition is a mixture of an abrasive and the metal bond described above. The abrasive preferably provides from about 5 to 50 volume % of the total abrasive composition, more preferably from about 5 to about 35 volume % of the total abrasive composition and most preferably from about 5 to about 20 volume % of the total abrasive composition. The abrasive which may be used includes for example diamond, cubic boron nitride, sol-gel aluminas, fused alumina, silicon carbide, flint, garnet and bubble alumina. The abrasive tools preferably contain one or more of these abrasives. The preferred abrasive is diamond. The abrasive grit size is based on the function or use of the abrasive tool and abrasive tools with more than one grit size sometimes being desirable. The bond described above preferably provides from about 50 to about 95 volume % of the total abrasive composition, more preferably from about 65 to about 95 volume of the total abrasive composition, and most preferably from about 80 to about 95 volume % of the total abrasive composition.

The abrasive composition is mixed by conventional mixing techniques known to those skilled in the art. The mixture of the abrasive composition is then is bonded to the metal core by processes known to those skilled in the art. Preferably the abrasive composition is hot-pressed together with the metal core to sinter the abrasive composition under pressure to the metal core which creates both a chemical and mechanical bond between the core and the abrasive composition. The wheel is preferably hot-pressed at temperatures above about 700° C., more preferably at temperatures above about 750° C., and most preferably at temperatures above about 800° C. The wheel is hot pressed preferably at pressures below about 4 tons per square inch, more preferably at pressures below about 3.5 tons per square inch, and most preferably at pressures below about 3 tons per square inch.

The present invention further includes a method of using an abrasive tool to grind glass. The method comprises the step of: grinding an edge of a piece of glass with an abrasive tool comprising a metal core; an abrasive composition comprising diamond and a metal bond bonded to the metal core, the metal bond comprising a filler with a Vickers hardness from about 300 kg/mm$^2$ to about 800 kg/mm$^2$ wherein the Vickers hardness of the filler is maintained above about 300 kg/mm$^2$ upon firing of the bond at a temperature of above 700° C. for at least about 10 minutes.

The piece of glass is preferably flat glass and the glass is ground by method known by those skilled in the art. The edge is preferably from about 0.040 to about 0.500 inches thick, more preferably from about 0.040 to about 0.320 inches thick, and most preferably from about 0.040 to about 0.250 inches thick. The edge of glass is preferably ground at linespeeds of above about 3.5 inches/second, more preferably ground at linespeeds of above about 4.5 inches/second, and most preferably ground at linespeeds of above about 5.5 inches/second.

In order that persons in the art may better understand the practice of the present invention, the following Examples are provided by way of illustration, and not by way of limitation. Additional background information known in the art may be found in the references and patents cited herein, which are hereby incorporated by reference.

EXAMPLES

Example 1

A metal bonded diamond glass edging wheel with dimensions of 10.040 inches by 0.620 inches by 7.530 inches was produced. Commercially available T15 Steel powder was obtained through a supplier. The T15 Steel Powder was sieved through a 30/40 U.S. mesh screen to remove flakes in the steel. The T15 Steel powder was then reduced in an oven at 200° C. for 6 hours in a controlled atmosphere of hydrogen and nitrogen. The T15 was then mixed with the other ingredients shown in Table I:

TABLE I

| Ingredients | Weight (grams) |
|---|---|
| T15 Steel (30–80 microns) | 114.0 |
| $TiH_2$ (1–3 microns) | 31.1 |
| WC (3.5–3.8 microns) | 40.7 |
| Silver (1 micron) | 87.7 |
| Copper (30 microns) | 33.9 |

The bond mixture was then screened through a 16/18 U.S. mesh screen to break up any agglomerates. The bond was then mixed with 16.5 grams of diamond abrasive of 180 grit size and blended for approximately 5 minutes in a Turbula Orbital mixer made by Bachofen.

The preform and a steel core were de-greased with a de-greasing solution to remove dirt and oil which could hinder bonding between the steel core and the abrasive composition. After drying the preform and the core, the abrasive composition (diamond-metal bond mixture) was poured into the cavity and leveled. A steel ring was placed on top of the cavity and 3 tons of pressure was applied. The mold assembly was then placed into a hot press and 5 tons of pressure was applied. The temperature of the hot-press was then increased to 820° C. When the temperature of the mold reached 770° C., the full hot-press pressure of 28 tons was applied as the temperature continued to rise.

The mold assembly was subsequently cooled in air to room temperature. The assembly was taken apart and the wheel was machined to its final dimensions. This included machining the sides, turning the inside diameter, turning and grinding the outside diameter and grinding a groove of a given radius and depth for edge grinding.

Example 2

The test wheels produced by the process described in Example 1 were compared with the competitors wheel, the Zurite-X10L TM, which was produced by Universal Superabrasives, Inc. of Chicago, Ill. and which contains an alloy steel. Both the wheels described in Example 1 and the competitors wheels where tested on glass edge grinding machine made by Sun Tool of Houston, Tex. The wheels used were 10 inches in diameter. The results are shown in Table II:

TABLE II

| Wheel | Wheel Life Before Truing (inches) | Linespeed (inches/sec) |
|---|---|---|
| T15 Steel | 383,000 | 4.1 |
| Low Alloy Steel | 270,000 | 3.5 |

This example shows that the T15 Steel increases both the wheel life and the efficiency of cut.

Example 3

The test wheels produced by the process described in Example 1 and were compared with the competitors wheel, the Zurite-X10 TM made by Universal Superabrasives, Inc. of Chicago, Ill. and which contains an alloy steel. Both the wheels described in Example 1 and the competitors wheels where tested on glass edge grinding machine made by Technoglass of Germany. The wheels used were 10 inches in diameter. The results are shown in Table III:

TABLE III

| Wheel | Total Wheel Life (inches) | Linespeed (inches/see) |
|---|---|---|
| T15 Steel | 2,376,000 | 8.2–9.5 |
| Alloy Steel | 1,584,000 | 8.2–9.5 |

This example shows that the T15 Steel increases the total wheel life at the same efficiency of cut.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. An abrasive tool comprising:

a metal core; and an abrasive composition comprising diamond and a metal bond bonded to the metal core, the metal bond comprising a filler wherein the hardness of the filler is maintained above about 300 kg/mm$^2$ upon firing of the bond at a temperature of above 700° C. for at least about 10 minutes.

2. The abrasive tool in claim 1, wherein the filler has a Vickers hardness from about 300 kg/mm$^2$ to about 800 kg/mm$^2$ before firing of the bond.

3. The abrasive tool in claim 1, wherein the metal core is steel.

4. The abrasive tool in claim 1, wherein the abrasive composition comprises from about 5 to about 50 volume % of the diamond and from about 50 to about 95 volume % of the metal bond.

5. The abrasive tool in claim 1, wherein the filler is steel.

6. The abrasive tool in claim 5, wherein the steel filler has a composition of about 5.1 wt % Co, 4.1 wt % Cr, 4.9 wt % V, 12.2 wt % W, 0.34 wt % Mn, 0.24 wt % Si, 1.43 wt % C, 0.02 wt % S, and a balance of Fe.

7. The abrasive tool in claim 1, wherein the hardness of the filler is maintained above about 300 kg/mm$^2$ upon firing of the bond at a temperature of above 750° C. for at least about 10 minutes.

8. The abrasive tool in claim 7, wherein the hardness of the filler is maintained above about 300 kg/mm$^2$ upon firing of the bond at a temperature of above 800° C. for at least about 10 minutes.

9. A bond comprising a filler wherein the filler is maintained above 300 kg/mm$^2$ upon firing of the bond at a temperature above 700° C. for at least about 10 minutes.

10. The bond in claim 9, wherein the filler has a Vickers hardness of from about 300 kg/mm$^2$ to about 800 kg/mm$^2$ before firing of the bond.

11. The bond in claim 9, wherein the filler is steel.

12. The bond in claim 11, wherein the steel filler has a composition of about 5.1 wt % Co, 4.1 wt % Cr, 4.9 wt % V, 12.2 wt % W, 0.34 wt % Mn, 0.24 wt % Si, 1.43 wt % C, 0.02 wt % S, and a balance of Fe.

13. The bond in claim 9, wherein the hardness of the filler is maintained above about 300 kg/mm$^2$ upon firing of the bond at a temperature of above 750° C. for at least about 10 minutes.

14. The bond in claim 13, wherein the hardness of the filler is maintained above about 300 kg/mm$^2$ upon firing of the bond at a temperature of above 800° C. for at least about 10 minutes.

* * * * *